US011062632B2

(12) United States Patent
Chen

(10) Patent No.: US 11,062,632 B2
(45) Date of Patent: Jul. 13, 2021

(54) METHOD AND DISPLAY DEVICE FOR DETECTING CONNECTION FAILURE OF DISPLAY DRIVER INTEGRATED CIRCUIT

(71) Applicant: Harman International Industries, Incorporated, Stamford, CT (US)

(72) Inventor: Havent Chen, Shanghai (CN)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 16/769,561

(22) PCT Filed: Dec. 14, 2017

(86) PCT No.: PCT/CN2017/116189
§ 371 (c)(1),
(2) Date: Jun. 3, 2020

(87) PCT Pub. No.: WO2019/113890
PCT Pub. Date: Jun. 20, 2019

(65) Prior Publication Data

US 2021/0166594 A1 Jun. 3, 2021

(51) Int. Cl.
*G09G 3/00* (2006.01)
*G09G 3/36* (2006.01)

(52) U.S. Cl.
CPC ..... *G09G 3/006* (2013.01); *G09G 3/3648* (2013.01); *G09G 2300/08* (2013.01); *G09G 2330/12* (2013.01)

(58) Field of Classification Search
CPC .. G09G 3/006; G09G 3/3648; G09G 2330/12; G09G 2300/08
See application file for complete search history.

(56) References Cited

U.S. PATENT DOCUMENTS

2013/0134986 A1* 5/2013 Yun ..... G09G 3/20 324/543
2016/0063907 A1 3/2016 Lin et al.

FOREIGN PATENT DOCUMENTS

| | | | |
|---|---|---|---|
| CN | 102122478 | A | 7/2011 |
| CN | 201974615 | U | 9/2011 |
| CN | 103137049 | A | 6/2013 |
| CN | 104240625 | A | 12/2014 |
| CN | 104965321 | A | 10/2015 |
| CN | 105044948 | A | 11/2015 |

(Continued)

*Primary Examiner* — Christopher J Kohlman
(74) *Attorney, Agent, or Firm* — Angela M. Brunetti

(57) ABSTRACT

A method and a display device for detecting connection failure of display driver IC (102, 202, 204, 302, 304). A display device comprises a display driver IC (102, 202, 204, 302, 304); a loop antenna (310); a detecting unit (312) coupled with the loop antenna (310) for detecting a frequency of a coupled signal on the loop antenna (310); and a processor (314) configured to control the display driver IC (102, 202, 204, 302, 304) to send a signal including a predetermined frequency to a scanning line or a data line of the display device; and analyze the frequency of the coupled signal on the loop antenna (310) to determine a connection failure of the display driver IC (102, 202, 204, 302, 304) corresponding to the scanning line or the data line. A solution for failure detection/diagnostic of the bonding issue of the display driver IC (102, 202, 204, 302, 304) of the display device.

20 Claims, 6 Drawing Sheets

(56) References Cited

FOREIGN PATENT DOCUMENTS

| | | | |
|---|---|---|---|
| CN | 106128351 | A | 11/2016 |
| JP | 09329796 | A | 12/1997 |

* cited by examiner

METHOD AND DISPLAY DEVICE FOR DETECTING CONNECTION FAILURE OF DISPLAY DRIVER INTEGRATED CIRCUIT

FIELD OF INVENTION

The present disclosure relates to display failure detection, and more particularly, relates to a method and device for detecting connection failure of a display driver integrated circuit (IC) in a display device.

BACKGROUND ART

There is an increasing demand to use more displays in a vehicle for function safety related modules, such as, cluster, rear view/side view mirror, which should comply with some specific requirements to ensure the safety of the vehicle.

ISO26262 is an international standard, which defines the requirement of functionality of electrical and/or electric systems in an automobile, and provides an automotive-specific risk-based approach for determining risk classes, i.e., Automotive Safety Integrity Levels (ASILs). There are four ASILs identified by the standard, i.e., ASIL A, ASIL B, ASIL C, ASIL D, wherein ASIL D dictates the highest integrity requirements on the product and ASIL A the lowest.

More and more automobile original equipment manufacturers (OEMs) require ASIL B for the function safety related modules using the displays, under which the display fault/failure detection is mandatory. Although display related failure detection may be performed to detect the status of some components of the display, such as, the power, the interface, and the memory, there is no detection of the bonding issue of the display driver IC in the art. The display driver IC is a key component of the display, which provides control signals to the display panel, and in case that the display driver IC has connection open issue with the display panel, the information may be lost on the screen. For example, as to a cluster display in the vehicle, which displays the critical vehicle status information, if some information is lost on the screen, the warning message and/or the status of the vehicle (e.g., the warning symbols of the speed, the fuel level, the temperature) may not be displayed or displayed improperly on the screen, which may bring a potential high risk to the occupants and the vehicle's safety.

Therefore, there is a need for a method and display device for detecting connection failure of the display driver IC in the display device.

SUMMARY OF THE INVENTION

According to one aspect of the present disclosure, a display device for detecting connection failure of a display driver IC is provided. The display device comprises a display driver IC; a loop antenna; a detecting unit coupled with the loop antenna for detecting a frequency of a coupled signal on the loop antenna; and a processor configured to control the display driver IC to send a signal including a predetermined frequency to a scanning line or a data line of the display device; and analyze the frequency of the coupled signal on the loop antenna to determine a connection failure between the display driver IC and the scanning line or the data line.

According to another one aspect of the present disclosure, a method for detecting connection failure of a display driver IC of a display device is provided, wherein the display device comprises a loop antenna, and the method comprises the display driver IC sending a signal including a predetermined frequency to a scanning line or a data line of the display device; detecting a frequency of a coupled signal on the loop antenna; and analyzing the frequency of the coupled signal on the loop antenna to determine a connection failure between the display driver IC and the scanning line or the data line.

According to yet another one aspect of the present disclosure, a computer-readable storage medium configured to implement the method set forth above is provided.

According to the present disclosure, it is possible to provide a failure detection/diagnostic of the bonding issue of the display driver IC of the display device, which may expand current failure detection coverage of the display device, and help the display device in the vehicle to achieve the functional safety goal (e.g. ASIL B).

The significance and benefits of the present disclosure will be clear from the following description of the embodiments. However, it should be understood that those embodiments are merely examples of how the invention can be implemented, and the meanings of the terms used to describe the invention are not limited to the specific ones in which they are used in the description of the embodiments.

Others Other systems, method, features and advantages of the disclosure will be, or will become, apparent to one with skill in the art upon examination of the following figures and detailed description. It is intended that all such additional systems, methods, features and advantages be included within this description, be within the scope of the disclosure, and be protected by the following claims.

BRIEF DESCRIPTION OF THE DRAWINGS

The disclosure can be better understood with reference to the flowing drawings and description. The components in the drawings are not necessarily to scale, emphasis instead being placed upon illustrating the principles of the disclosure. Moreover, in the figures, like reference numerals designate corresponding parts throughout the different views.

BRIEF DESCRIPTION OF THE PREFERRED EMBODIMENTS

Hereinafter, the preferred embodiment of the present invention will be described in more detail with reference to the accompanying drawings. In the following description of the present invention, a detailed description of known functions and configurations incorporated herein will be omitted when it may make the subject matter of the present invention rather unclear.

In the following, the TFT LCD display is discussed as an example. The architecture and the concept of the present disclosure may be applied to other types of the display device for detecting the connection failure of the display driver IC.

Figure 1A:
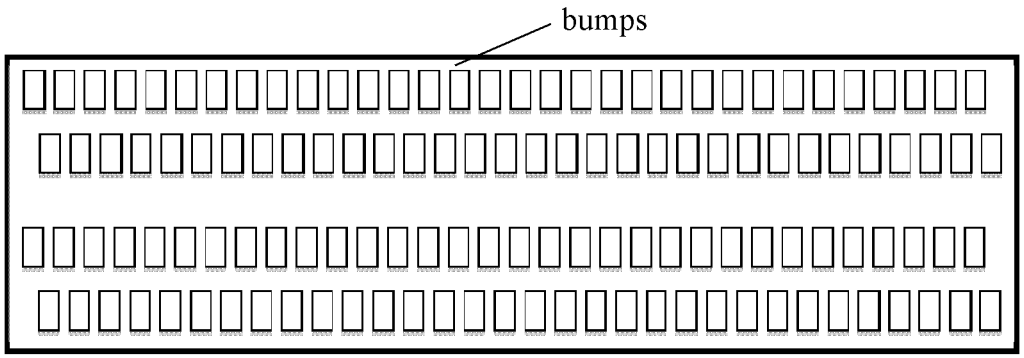
FIG. 1A is a schematic diagram of the bottom view of the display driver IC.

FIG. 1A is a schematic diagram of the bottom view of the display driver IC. The display driver IC may be configured to drive the display panel to display an image. The display driver IC may include a source driver and a gate driver integrated in a signal chip, or may include more than one chip, such as, one or more source driver ICs and/or one or more gate driver ICs. As shown in FIG. 1, the display driver IC has bumps facing out for each signal, such as, gold bumps, solder bumps, etc. The pad pattern of the display driver IC is not limited to that as shown in FIG. 1A, and the pads of the display driver IC may be formed by any appropriate integrated circuit packaging technologies.

Figure 1B:
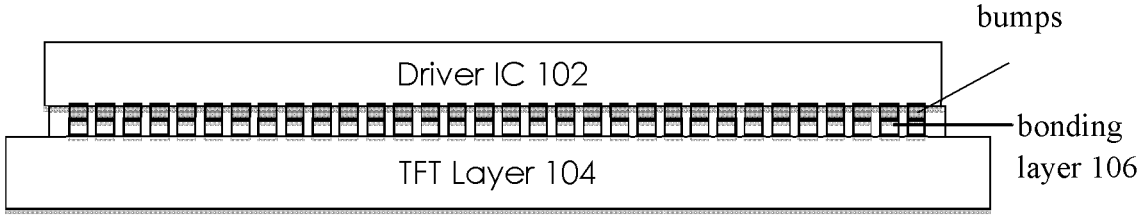
FIG. 1B is a schematic diagram of the sectional view of the display driver IC connecting with the TFT layer.

FIG. 1B is a schematic diagram of the sectional view of the display driver IC connecting with the TFT layer. As shown in FIG. 1B, the bumps of the display driver IC are bonded on the TFT layer by a bonding layer 106. The bonding layer 106 is used to bond the display driver IC pads with the pads on the TFT layer, such as, the Indium Tin Oxide (ITO) pads or other alloyed metal material pads on the TFT layer, and the bonding layer 106 may include conductive adhesive material(s), such as, anisotropic conductive film (ACF), Anisotropic Conductive Adhesives/Paste (ACA/ACP), etc. If there is a reliability issue of the conductive adhesive material, such as ACF, the connection between the display driver IC and the TFT layer would be unstable. For instance, the bonding issue may be a high potential failure in consideration of the ACF glue performance degradation under high temperature conditions. The connection failure may occur between the display driver IC pads and the TFT layer due to reliability issue of the conductive adhesive material(s) (such as, aging of the material(s)), extreme ambient temperature, vibration, or other predictable or unpredictable reasons. The connection failure between any pad of the display driver IC and the TFT layer may lead to a display error on the display device.

Figure 2A:
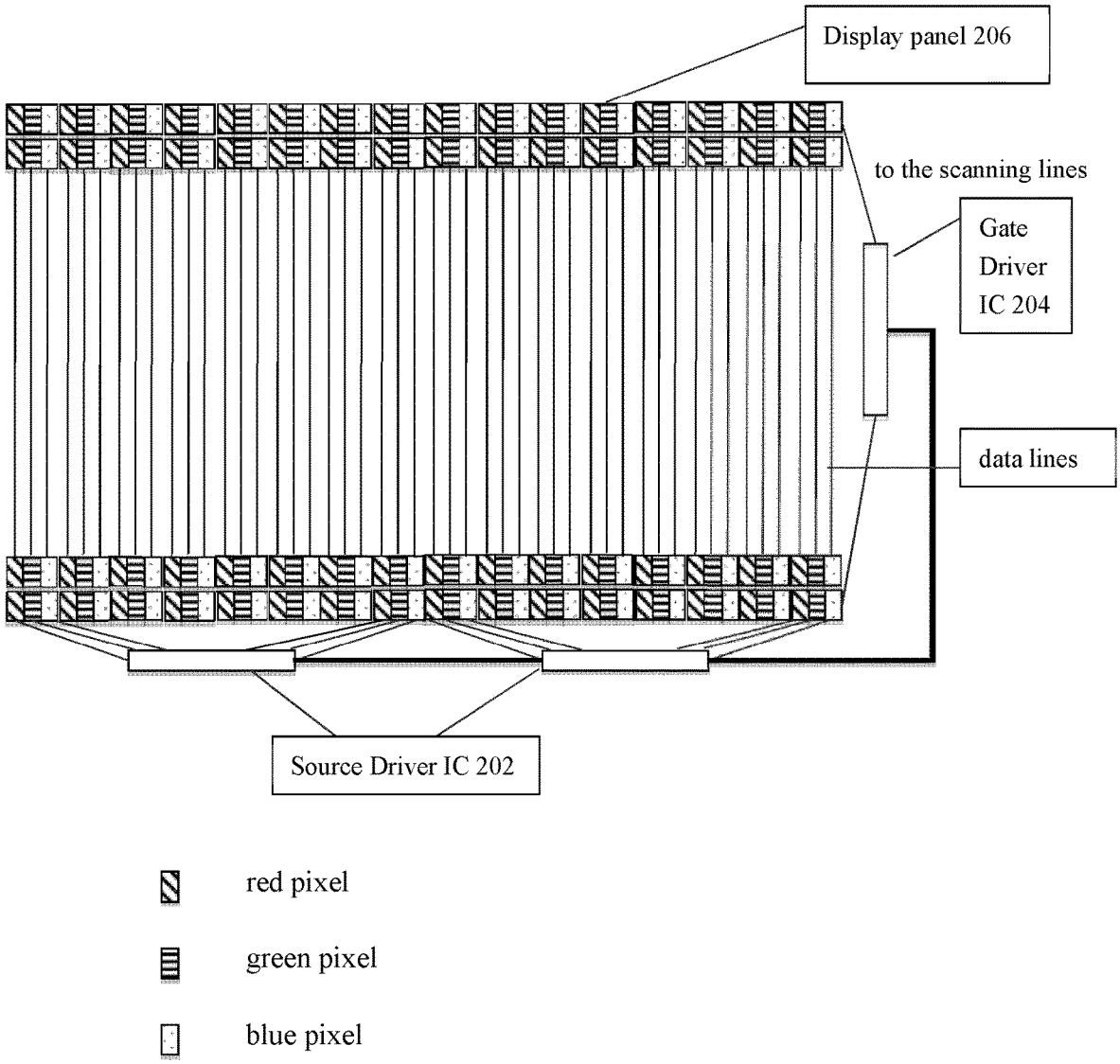
FIG. 2A is a schematic diagram of the circuit connection between the display driver IC and the display panel.

FIG. 2A is a schematic diagram of the circuit connection between the display driver IC and the display panel. As shown in FIG. 2A, the display panel 206 may employ three primary colors, i.e., Red, Green, and Blue, and thus each pixel may include three sub-pixels. The display panel may employ four (e.g., Red, Green, Blue, and White or Red, Green, Blue, Yellow), five (e.g., Red, Green, Blue, Yellow, White) or other number of the primary colors, which is not limited in the present disclosure. There are a plurality of pixels arranged into a matrix on the display panel 206, a plurality of data lines each connected to a column of pixels, and a plurality of scanning lines each connected to a row of pixels. One or more source driver ICs 202 are provided to drive the data lines, and one or more gate driver ICs 204 are provided to drive the scanning lines. Although there are two source driver ICs and one gate driver IC as shown in FIG. 2A, the number of the display driver ICs is not limited in the present disclosure.

The source driver IC(s) and the gate driver IC(s) may be connected to a host processor (see FIG. 3) through the control line(s) to receive the control signals and instructions from the host processor. If a connection failure occurs between one pad of the display driver IC and the corresponding pad of the TFT layer, the pixels corresponding to the pad of the display driver IC would be displayed incorrectly.

Figure 2B:
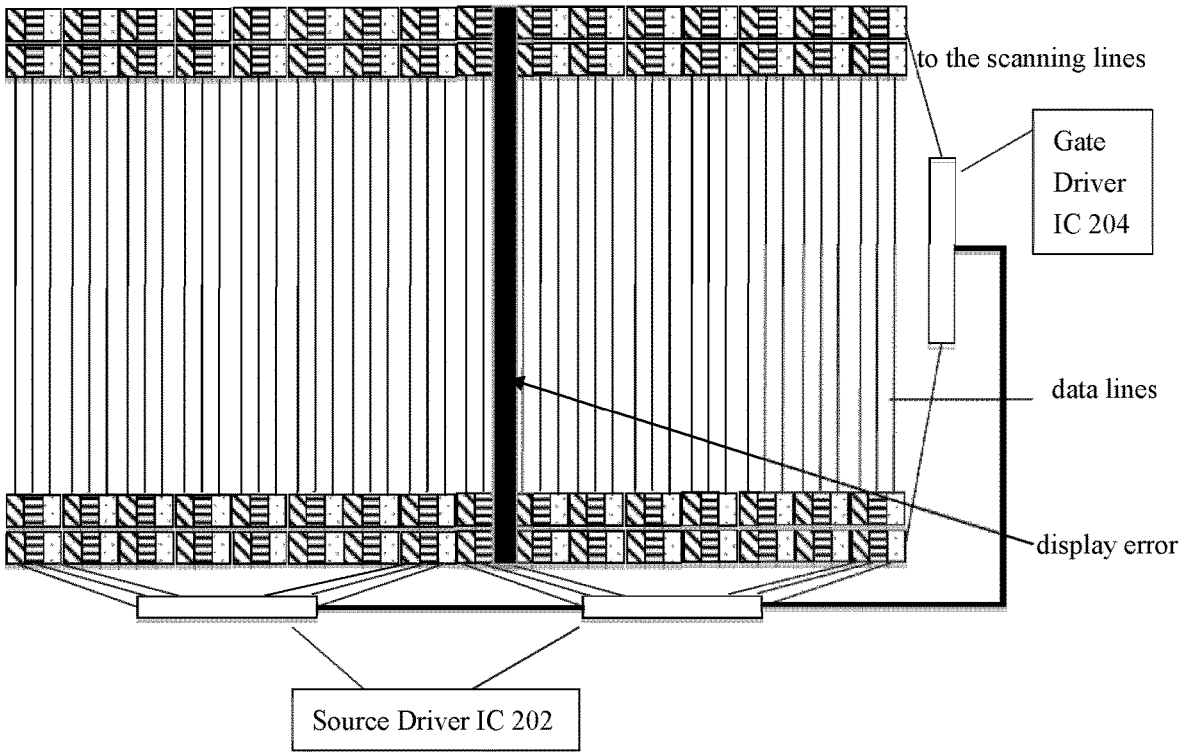
FIG. 2B shows an example of the connection failure between the display driver IC and the TFT layer.

FIG. 2B shows an example of the connection failure between the display driver IC and the TFT layer. As shown in FIG. 2B, a pad of the source driver IC is disconnected with the corresponding pad of the TFT layer, then the signal sent from the source driver IC cannot arrive at the corresponding data line, and thus the corresponding column of the sub-pixels (which is pointed by the arrow) cannot be enabled and the pixels including the sub-pixels are unable to show the correct color.

Similarly, if the failure occurs between a pad of the gate driver IC and the corresponding pad of the TFT layer, the corresponding row of the pixels would lose control from the display driver IC, and cannot be enabled by the display driver IC. Those pixels may be unable to show the correct color.

Figure 3:
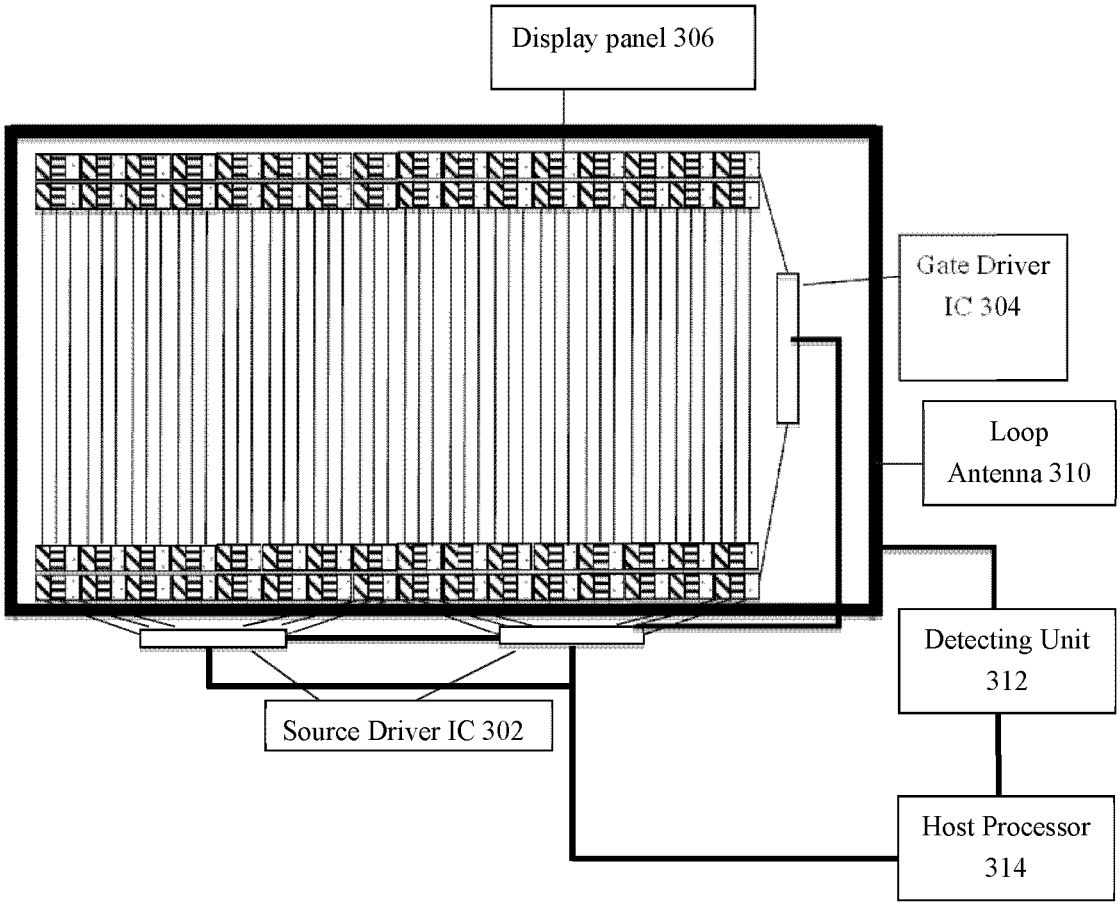
FIG. 3 is a schematic diagram of the display device detecting the connection failure of the display driver IC according to one of embodiments of the present disclosure.

FIG. 3 is a schematic diagram of the display device detecting the connection failure of the display driver IC according to one of embodiments of the present disclosure.

As shown in FIG. 3, the display device comprises, among others, a source driver IC 302, a gate driver IC 304, a display panel 306, a loop antenna 310, a detecting unit 312, and a host processor 314. The connection and the function of the source driver IC 302, the gate driver IC 304 and the display panel 306 are respectively similar to those of the source driver IC 202, the gate driver IC 204 and the display panel 206 as shown in FIG. 2A and FIG. 2B, and thus they are not described in detail hereinafter.

The host processor 314 may be a processor in the current display device, such as, a graphics processor for controlling the display process of the display device, or the detection process may be performed by an additional processor in the display device (not shown). In order to detect the connection failure between the display driver IC(s) and the TFT layer, the host processor 314 controls the display driver IC(s) to output a signal with a predetermined frequency to one or more of the data lines and/or the scanning lines, and receives the feedback from a detecting unit 312 to determine whether the corresponding pad of the display driver IC(s) is well connected with the TFT layer. The detection process may be performed for each pad of all display driver ICs, or the detection process may be performed for one or some pads of all display driver ICs.

As shown in FIG. 3, the loop antenna 310 is provided around the display panel 306 for coupling/sensing the signal on the scanning lines and/or the gate lines. The loop antenna 310 may be provided around the edge of the TFT layer (as shown in FIG. 3), on the TFT layer, or on one or more other layers of the LCD display device, as long as the antenna may couple the signal on the scanning lines and/or the gate lines. In addition, the loop antenna 310 may have different forms, such as, a rectangle, square, circle, triangle, ellipse, or any other closed geometric shape, and may have one or more turns, which are not limited in the present disclosure. The loop antenna 310 may be formed by one or more wires, and there may be more than one loop antenna provided in the display device. For example, the loop antenna 310 may be formed by one or more ITO wires. The loop antenna 310 may be formed by other materials, such as, copper, aluminum, alloy, etc.

After one of the display driver ICs sends a signal with a predetermined frequency through a pad to the corresponding one of the data lines and the gate lines, the loop antenna 310 may generate a coupled signal corresponding to the signal sent from the display driver IC if the pad of the display driver IC and the TFT layer are well connected. If the connection between the pad of the display driver IC and the TFT layer is failed, the signal sent from the display driver IC cannot be transmitted to the corresponding one of the data lines and the scanning lines, and thus the loop antenna 310 cannot output a signal coupled to the signal with the predetermined frequency. Therefore, the connection between the pad of the display driver IC and the TFT layer may be determined by comparing the signal sent from the display driver IC and the coupled signal on the loop antenna.

Since there may be much noise in the environment, the signal outputted from the antenna may include a component with a frequency corresponding to the noise in the environment. If there is a noise signal having a frequency equal or approximate to that of the detecting signal, the antenna may output a signal with a frequency substantially corresponding to that of the detecting signal outputted from the display driver IC even if the corresponding pad of the display driver IC(s) is disconnected with the TFT layer, which may cause diagnosis error. In order to reduce the rate of the fault diagnosis error, the detecting signal outputted from the display driver IC(s) may have more than one frequency so as to avoid the interference from the noise signals in the environment. For example, the display driver IC(s) may send one of the data lines and/or the scanning lines two different frequencies with time division, and if two signals with the two different frequencies are both received by the antenna, it would be determined that the corresponding pad of the display driver IC(s) is well connected with the TFT layer. Furthermore, two different frequencies may be sent from the display driver IC(s) simultaneously, which may require the sending side (i.e., the display driver IC) including a diplexer design and the receiving side (i.e., the detecting unit) including a splitter design so as to separate the received signal and make the measurement of the two different frequencies independently.

Figure 4:
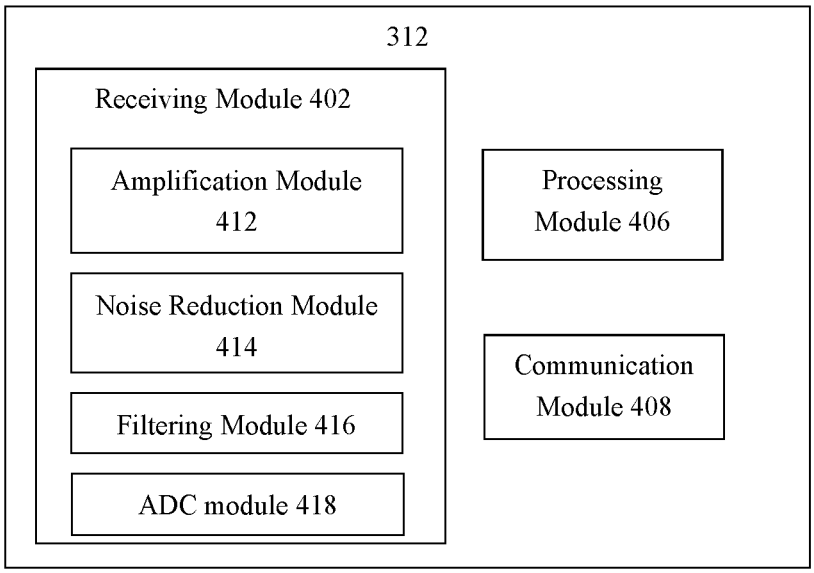
FIG. 4 is a schematic block diagram of the detecting unit according to one of embodiments of the present disclosure.

As shown in FIG. 3, the detecting unit 312 detects the frequency and the voltage of the coupled signal received from the loop antenna 310. FIG. 4 is a schematic block diagram of the detecting unit 312 according to one of or more embodiments of the present disclosure. The detecting unit 312 may be implemented by a MicroController Unit (MCU) and its peripheral circuit. For example, a band pass filter circuit out of the MCU may be used to filter out the expected frequency and use an ADC (analog to digital converter) module inside/outside the MCU to sample the amplitude of the coupled signal with 2X frequency of the detecting signal.

Alternatively, all or part of the detecting unit 312 may be implemented by the display driver IC itself or integrated with the display driver IC, which means that the display driver IC may both send out the detecting signal, and receive and analyze the coupled signal from the antenna.

The detecting unit 312 may be implemented by various types of processing units, including but not limited to, MicroController Unit (MCU), Complex Programmable Logic Device (CPLD), Field Programmable Gate Array (FPGA), Digital Signal Processing (DSP), as long as they may determine the frequency and voltage of the signal received from the antenna, and have communication interface (such as, SPI, I2C).

As shown in FIG. 4, the detecting unit 312 may include a receiving module 402, a processing module 406, and a communication module 408.

The receiving module 402 receives the coupled signal from the antenna. The coupled signal may include noises coupled from other signals in the display or in the environment, and the receiving module 402 may include the amplification module 412, the noise reduction module 414, and/or a filtering module 416 so as to obtain a signal with the expected frequency from the coupled signal. The signal from the antenna may be further processed by an ADC module 418 in the receiving module 402.

The processing module 406 and the communication module 408 may be implemented by a MCU or other type of the processing unit. The processing module 406 receives the processed coupled signal and determines the voltage and the frequency of the coupled signal. For illustrative purpose only, the Vpp (peak to peak) of the voltage may be in the range of 1.0V to 3.3V, and the frequency setting may be from 100 KHz to 10 MHz in low frequency band for example.

If the signal sent to one of the data lines and scanning lines includes more than one frequency, the more than one frequency included in the coupled signal may be determined by the processing module 406. The communication module 408 is used to communicate with the host processor 314 so as to receive the data and/or instruction from the host processor 314 and send the detection result or other feedback to the host processor 314. Further, the processing module 406 may be implemented by the host processor 314, and thus the communication module 408 may be omitted.

Figure 5:
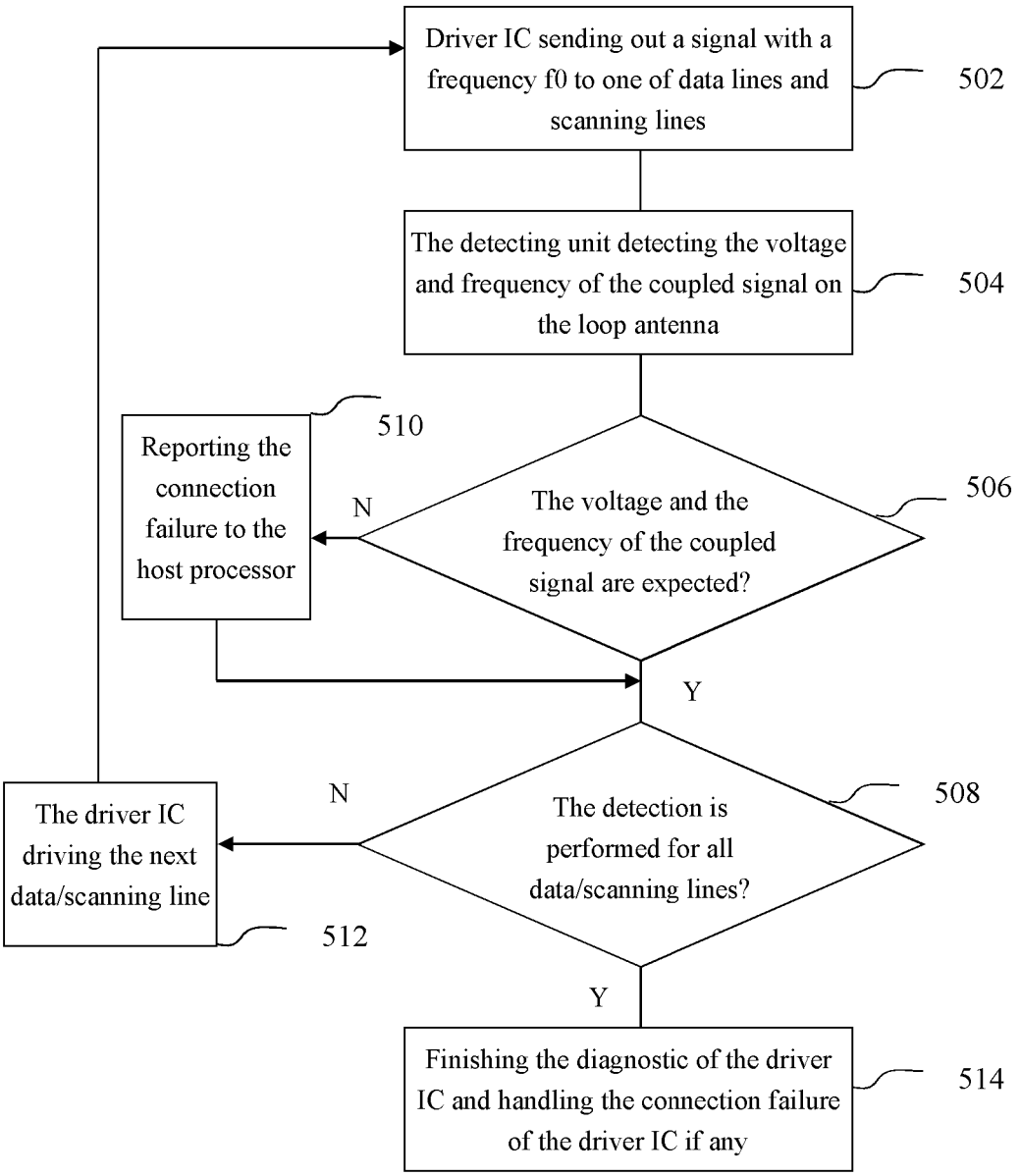
FIG. 5 is a flow diagram of determining the connection failure of the display driver IC according to one of embodiments of the present disclosure.

The process of the connection detection is described in details detail with reference to FIG. 5. FIG. 5 is a flow diagram of determining the connection failure of the display driver IC according to one of embodiments of the present disclosure. As shown in FIG. 5, the display driver IC sends out a signal with a predetermined frequency f0 through a corresponding pad of the display driver IC to one of the data lines and scanning lines (step 502). The signal with the frequency f0 is coupled to the loop antenna through the air if the corresponding pad of the display driver IC is well connected with the TFT layer. The detecting unit 312 determines the voltage and the frequency of the coupled signal on the loop antenna (step 504).

The frequency of the coupled signal may be a frequency combination if the signal sent out from the display driver IC includes more than one frequency. In order to reduce the interference from the noises, the amplitude of the signal sent out from the display driver IC should be large enough so that the voltage of the signal coupled by the loop antenna may be detected by the detecting unit. For example, the voltage may be from 3.3V to 10V according to the display driver IC capability. In order to differentiate the useful signal from the noises, a voltage threshold may be provided for the coupled voltage. If the voltage of the coupled signal is below the voltage threshold, the detecting unit 312 determines that the voltage of the coupled signal is not the expected voltage, and may send the report to the host processor 314 or require detecting the pad of the display driver IC again. Meanwhile, the detecting unit 312 may determine whether the frequency of the coupled signal corresponds to f0. Generally, the coupled signal may have the same frequency as that of the signal sent from the display driver IC. That is to say, if the frequency of the coupled signal is equal to f0, the detecting unit 312 determines that the frequency of the coupled signal is the expected frequency. When both the frequency and the voltage of the coupled signal are expected (step 506), the detection will proceed to the next pad of the display driver IC (step 512).

Nonetheless, as to the step 504 and the step 506, determining and comparing only the frequency of the coupled signal may be enough for determining the connection failure of the display driver IC.

When any of the frequency and/or the voltage of the coupled signal is unexpected (step 506), the detecting unit will report the connection failure to the host processor 314 (step 510), and/or require detecting the corresponding pad again.

After receiving the report from the detecting unit, the host processor 314 determines which pad of the display driver ICs is disconnected with the TFT layer. The host processor 314 may record the event of the connection failure of the corresponding pad in the memory, or may control the corresponding display driver IC to perform the detection again to confirm the connection failure.

When the detection has been performed for all display driver ICs to be detected, the detecting unit or the host processor determines whether the detection has been performed for all data and scanning lines of the display driver ICs (step 508). If not, the detection would be performed for the next data or scanning line. After finishing the detection, the host processor may determine that the diagnostic of all display driver ICs to be detected has been finished, record the bonding status of the display driver ICs, and handle the connection failure if it exists in any display driver IC (step 514).

The detection process may be performed when the display device is powered on, or when the display device is in the standby mode, or at any other time which does not affect the use of the display device.

As to the disconnected pad of the display driver IC, the corresponding screen area may be dummy, and is not able to show the correct information for the user. The host processor may handle the failure process per se, or send a detection result to another processor in the display device or to the remote server for further processing.

In order to avoid the hazard to the vehicle caused by the connection failure between the display driver IC(s) and the TFT layer, handling the connection failure by the processor (step 514) may include any of warning the user of the connection failure; displaying the image on the display device avoiding using a failed area on the display device resulted from the connection failure; and sending an image corresponding to a failed area on the display device resulted from the connection failure to another display device for display.

In particular, the failure may be reported to the user by showing or flashing the warning message on the display device or other related display device or play a sound (e.g., a beep) so as to get the user aware of the failure. Moreover, the specific area on the screen affected by the connection failure may be reported to the user so that the user may know what information is unable to be shown on the screen. For example, if a connection failure occurs in a cluster display in a vehicle, some of the gauges and indicators that drivers depend on to learn important information on the status of the vehicle may be incorrectly displayed. In order to inform the driver of the connection failure, a warning message may be shown on the cluster display or the infotainment display to indicate the connection failure, and may further indicate which area or which indicator in the cluster that cannot be displayed correctly. After that, the user may contact the vehicle service center for help, such as, replacing or repairing the display device.

Alternatively, the host processor in the display device may reorganized the screen image to skip the failed area as a temporary solution, which means that the image data is not allocated on the failed area, but displayed on other area.

Alternatively, the host processor or another processor in the display device may send the data of the image to be displayed on the failed area to another display device. For example, if the cluster display has failure, the data of the image may be transferred from the cluster display to the infotainment display, and the latter displays the image for the user.

Also, the remote server may receive the report of the connection failure and instruct the display device and/or help the user to handle the failure.

One advantage of the techniques described herein is that a bonding issue of the display driver IC can be detected so as to minimize the impact of display errors on the user with low cost and high reliability. Particularly, the techniques described herein may help the display device/system to achieve the function safety goal (e.g., ASIL B for a display in a vehicle).

It will be understood by persons skilled in the art, that one or more processes or sub-processes described in connection with the drawings may be performed by hardware and/or software. If the process is performed by software, the software may reside in software memory (not shown) in a suitable electronic processing component or system. The software in the memory may include executable instructions for implementing logical functions (that is, "logic" that may be implemented either in digital form such as digital circuitry or source code or in analog form such as analog circuitry or an analog source such as an analog electrical signal), and may selectively be embodied in any computer-readable medium for use by or in connection with an instruction execution system, apparatus, or device. The computer readable medium may selectively be, for example, but is not limited to, an electronic, magnetic, optical, electromagnetic, infrared, or semiconductor system, apparatus or device, such as, a RAM, a ROM, an EPROM, etc.

With regard to the processes, systems, methods, heuristics, etc., described herein, it should be understood that, although the steps of such processes, etc., have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

To clarify the use in the pending claims and to hereby provide notice to the public, the phrases "at least one of <A>, <B>, . . . and <N>" or "at least one of <A>, <B>, . . . <N>, or combinations thereof" are defined by the Applicant in the broadest sense, superseding any other implied definitions hereinbefore or hereinafter unless expressly asserted by the Applicant to the contrary, to mean one or more elements selected from the group comprising A, B, . . . and N, that is to say, any combination of one or more of the elements A, B, . . . or N including any one element alone or in combination with one or more of the other elements which may also include, in combination, additional elements not listed.

While various embodiments of the disclosure have been described, it will be apparent to those of ordinary skill in the art that many more embodiments and implementations are possible that are within the scope of the disclosure. Accordingly, the disclosure is not to be restricted except in light of the attached claims and their equivalents.

The invention claimed is:

1. A display device, comprising:

a display driver integrated circuit (IC);

a loop antenna;

a detecting unit coupled with the loop antenna for detecting a frequency of a coupled signal on the loop antenna; and a processor configured to control the display driver IC to send a signal including a predetermined frequency to a scanning line or a data line of the display device; and analyze the frequency of the coupled signal on the loop antenna to determine a connection failure between the display driver IC and the scanning line or the data line.

2. The display device of claim 1, further comprising a thin film transistor (TFT) layer, wherein the loop antenna is provided around the TFT layer, and the connection failure is a bonding failure between the display driver IC and the TFT layer.

3. The display device of claim 2, wherein the loop antenna is provided on the TFT layer.

4. The display device of claim 1, wherein the display device comprises one or more loop antennas.

5. The display device of claim 1, wherein the processor is configured to analyze the frequency of the coupled signal on the loop antenna by comparing the frequency of the coupled signal with the signal sent from the display driver IC.

6. The display device of claim 1, wherein the processor is configured to determine the connection failure between the display driver IC and the scanning line or the data line when the frequency of the coupled signal is different from the frequency of the signal sent from the display driver IC.

7. The display device of claim 1, wherein the processor is further configured to warn a user of the connection failure when the connection failure of the display driver IC is determined.

8. The display device of claim 1, wherein the processor is configured to display an image on the display device avoiding using a failed area on the display device resulted from the connection failure when the connection failure of the display driver IC is determined.

9. The display device of claim 1, wherein the processor is configured to send an image corresponding to a failed area on the display device resulted from the connection failure to another display device for display when the connection failure of the display driver IC is determined.

10. The display device of claim 1, wherein the detecting unit detects a voltage of the coupled signal on the loop antenna, and the processor is further configured to analyze the voltage of the coupled signal on the loop antenna to detect a connection failure between the display driver IC and the scanning line or the data line.

11. The display device of claim 1, wherein the detecting unit is integrated in the display driver IC.

12. A method for detecting connection failure of a display driver IC of a display device, wherein the display device comprises a loop antenna, the method comprising the display driver integrated circuit (IC) sending a signal including a predetermined frequency to a scanning line or a data line of the display device;

detecting a frequency of a coupled signal on the loop antenna; and analyzing the frequency of the coupled signal on the loop antenna to determine a connection failure between the display driver IC and the scanning line or the data line.

13. The method of claim 12, wherein the display device comprises a thin film transistor (TFT) layer, the loop antenna is provided around the TFT layer, and the connection failure is a bonding failure between the display driver IC and the TFT layer.

14. The method of claim 12, wherein the frequency of the coupled signal is analyzed by comparing the frequency of the coupled signal with the signal sent from the display driver IC.

15. The method of claim 12, wherein the connection failure between the display driver IC and the scanning line or the data line is determined when the frequency of the coupled signal is different from the frequency of the signal sent from the display driver IC.

16. The method of claim 12, further comprising warning a user of the connection failure when the connection failure of the display driver IC is determined.

17. The method of claim 12, further comprising displaying an image on the display device avoiding using a failed area on the display device resulted from the connection failure when the connection failure of the display driver IC is determined.

18. The method of claim 12, further comprising sending an image corresponding to a failed area on the display device resulted from the connection failure to another display device for display when the connection failure of the display driver IC is determined.

19. The method of claim 12, further comprising detecting a voltage of the coupled signal on the loop antenna, and analyzing the voltage of the coupled signal on the loop antenna to determine the connection failure between the display driver IC and the scanning line or the data line.

20. A non-transitory computer-readable storage medium including instructions that, when executed by one or more processors, configure the one or more processors to perform the steps of:

sending a signal including a predetermined frequency to a scanning line or a data line of a display device, which includes a display driver integrated circuit and a loop antenna;

detecting a frequency of a coupled signal on the loop antenna; and analyzing the frequency of the coupled signal on the loop antenna to determine a connection failure between the driver IC and the scanning line or the data line.

* * * * *